United States Patent [19]

Antonucci

[11] 4,318,367

[45] Mar. 9, 1982

[54] ENERGY RECOVERY DEVICE

[76] Inventor: Louis T. Antonucci, 1 Callahan St., East Hanover, N.J. 07936

[21] Appl. No.: 154,938

[22] Filed: May 30, 1980

[51] Int. Cl.[3] ..... F22B 33/00

[52] U.S. Cl. ..... 122/20 B; 237/1 R; 165/38; 165/DIG. 2

[58] Field of Search ..... 237/8 R, 55, 54, 1 R; 126/110 R; 122/DIG. 1, 20 B; 165/DIG. 2, 37, 38, 122

[56] References Cited

U.S. PATENT DOCUMENTS

| | | | |
|---|---|---|---|
| 2,567,452 | 9/1951 | Strahan | 165/38 |
| 3,442,324 | 5/1969 | Clay | 165/38 |
| 3,568,924 | 3/1971 | Chenault | 237/1 |
| 3,813,039 | 5/1974 | Wells | 165/38 |
| 4,232,657 | 11/1980 | Killorin | 165/DIG. 2 |

*Primary Examiner*—Albert J. Makay
*Assistant Examiner*—Henry Bennett
*Attorney, Agent, or Firm*—Weingram & Klauber

[57] ABSTRACT

An energy recovery device can be installed in the exhaust of heat producing equipment. The device includes a conduit having a main and bypass chamber. Also included are fluid conducting coils which are mounted within the main chamber for passing fluid therethrough. A relief device operates to connect in parallel the main and bypass chambers in response to a differential pressure therebetween exceeding a predetermined magnitude. Therefore it is estimated that approximately 50–85% of wasted energy through the flue pipe can be recovered and utilized for said system depending upon the size of the unit.

17 Claims, 6 Drawing Figures

FIG. 1
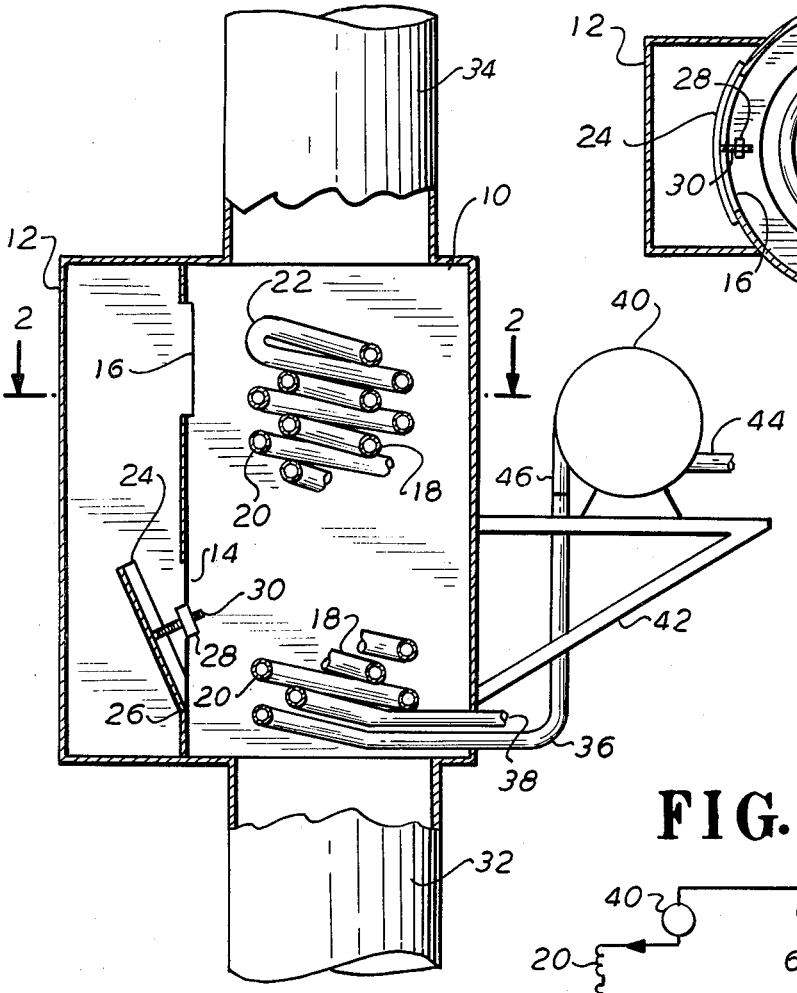
FIG. 2
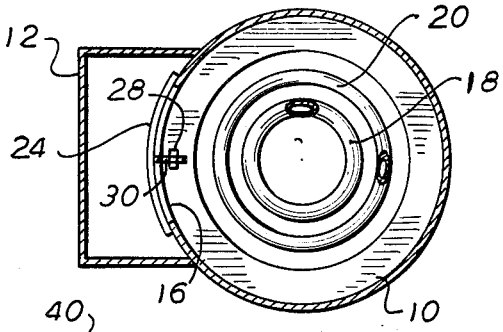
FIG. 3
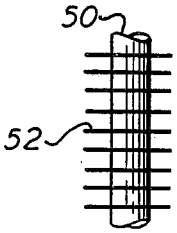
FIG. 4
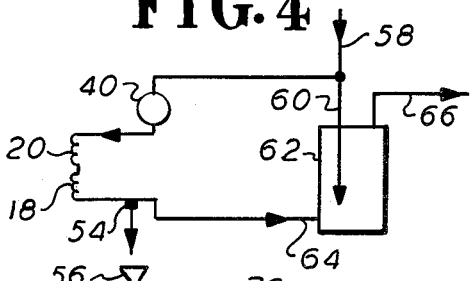
FIG. 6
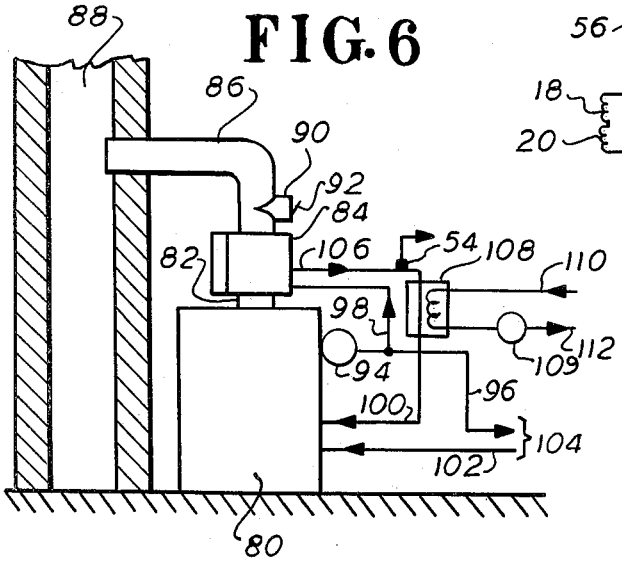
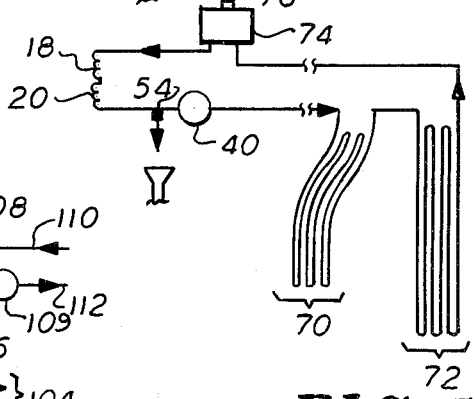
FIG. 5

ENERGY RECOVERY DEVICE

BACKGROUND OF THE INVENTION

The present invention relates to energy recovery devices and in particular to devices installed in the exhaust of heating equipment to recover waste heat.

It is known to install a fluid conducting coil in the chimney of a furnace to capture waste heat flowing therein. However, many of these devices restrict the updraft of the chimney. For some chimneys or flues it is not feasible to withdraw a significant amount of waste heat from the exhaust without dangerously reducing updraft. Since the updraft depends upon the operating conditions of the furnace as well as wind conditions, the coil inserted in the flue or chimney ought to be conservatively small to avoid a back pressure that might cause exhaust to leak into the furnace room.

The difficulty of sustaining sufficient updraft is acute for embodiments employing a known double helical heating coil in a chimney. While the double coil is relatively efficient its increased surface area tends to restrict updraft.

Known heat recovery systems have provided alternate exhaust paths, a heat recovery coil being installed in one of these alternate paths. In the latter instance the alternate paths are manually controlled by an operator whenever he wishes to recover exhaust heat. The systems employing alternate exhaust paths do not efficiently extract waste heat since their heat recovery coils are relatively inefficient and must be designed very conservatively to avoid interfering with updraft as conditions change dynamically.

Accordingly, there is a need for an effective heat recovery device which can withdraw a significant amount of waste heat from the exhaust of heat producing equipment. Furthermore, such heat recovery devices ought not to interfere with the normal updraft.

SUMMARY OF THE INVENTION

In accordance with the illustrative embodiments demonstrating features and advantages of the present invention there is provided an energy recovery device for installation in the exhaust of heat producing equipment. The energy recovery device includes a conduit having a main and bypass chamber. A fluid conducting means is mounted within the main chamber for passing fluid therethrough. Also included in the energy recovery device is a relief means for connecting in parallel the main and bypass chambers. The relief means responds to the differential pressure between the main and bypass chamber exceeding a predetermined magnitude.

By employing the foregoing equipment, a device according to the present invention is able to simultaneously achieve two otherwise inconsistent goals: recovering a high percentage of waste heat; and promoting strong updraft. The present invention achieves these goals with a chambered conduit whose flow patterns are altered in response to excessive differential pressures within the conduit.

In a preferred embodiment a cylindrical main chamber contains a nested pair of helical coils mounted with a bypass chamber across the main chamber. These two chambers are multiply connected and may be connected in parallel by the opening of a flap. This flap opens when the differential pressure between the two chambers becomes excessive. Thus, dangerously high back pressure and leaking of exhaust gas is avoided. This response to changing conditions is automatic and thus the updraft and heat recovery operations are kept in harmonious balance.

In the preferred embodiment the nested pair of helical coils have different diameters. Preferably, water is first delivered to the larger outer coil where the exhaust temperature is lower than in the center of the chamber. The two coils may be connected so that the water spirals upwardly throughout the outer coil and then downwardly spirals through the inner coil. It is also preferred that the coils be finned to provide maximum heat transfer between exhaust and water.

An energy recovering device according to the present invention can be installed in many systems and for various applications. For example, the present energy recovery device can preheat the water to a hot water heater. Alternatively, the present energy recovery device may be connected in circuit with a pump and subsurface melting pipes to melt surface ice and snow. In the latter embodiment the system may be connected to an expansion tank which is also a convenient port for adding antifreeze.

Also, for embodiments cooperating with a hot water furnace the heat recovery device may preheat water returning to the furnace to boost its efficiency. Also, it is expected that the heat recovery device can circulate through an external heat exchanger whose output coils are used to preheat the potable water delivered to a hot water heater.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention, when taken in conjunction with the accompanying drawings wherein:

FIG. 1 is an elevational view, partly in section, of an energy recovery device according to the present invention;

FIG. 2 is a sectional view along lines 2—2 of FIG. 1;

FIG. 3 is a detailed view of a section of the coils in the device of FIG. 1;

FIG. 4 is a schematic illustration of a system employing the device of FIG. 1;

FIG. 5 is a schematic illustration of another system employing the device of FIG. 1; and FIG. 6 is a schematic illustration of still another system employing the device of FIG. 1.

DETAILED DESCRIPTION OF THE PREFERRED EMBODIMENTS

Referring to FIGS. 1 and 2, there is shown an energy recovery device comprising a conduit having a main chamber 10 and a bypass chamber 12. Chamber 10 is essentially a cylindrical housing while bypass chamber 12 is a rectangular housing welded or riveted or other mechanical means to the side of chamber 10. Chambers 10 and 12 are multiply connected at upstream port 14 and downstream port 16, both parts being rectangular openings. It is to be appreciated that other shapes may be employed for main chambers 10 and 12. For example, both may be rectangular or both may be cylindrical. In addition, they may be connected by only one port, but a port sized to allow sufficient bypassing of exhaust from main chamber 10. Also, the dimensions of the chambers may be chosen in accordance with the expected volume of exhaust and the percentage of waste heat to be recaptured.

Also shown herein is a fluid conducting means, which is, in this embodiment, a nested pair of helical coils. These coils include inner coil 18 and outer coil 20 whose central sections have been broken away in FIG. 1 for clarity. Chambers 10 and 12 and coils 18 and 20 have also been sectioned along a central plane. It is also to be noted that inner and outer coils 20 and 18 each comprise nine turns and they have been joined together at their adjacent upper ends at crossover 22.

Inner coil 18 spirals on a circle having a diameter of 3.5 inches while the outer coil spirals on a circle having a diameter of 6.0 inches. In this embodiment main chamber 10 is 18 inches high and has an inside diameter of 12 inches. However, these dimensions can be varied depending upon the volume of exhaust gas, the amount of heat which must be extracted, weight limitations, etc.

While a pair of nested coils is shown herein other structures are anticipated. It is preferred that the chosen structure have piping that follows a serpentine path so that the exhaust is intimately contacted. Thus, for some embodiments the piping may oscillate in an axial direction around or near the circumference of the main chamber. For other embodiments, the coils may spiral inwardly, following a conical surface.

A relief means is shown herein as flap 24 which is essentially a cylindrical section. Flap 24 is hinged at its lower end 26 and is sized to cover port 14. Flap 24 is biased towards a closed position by weight 28 which is threadably attached to screw post 30. Flap 24 is held closed unless the pressure in main chamber 10 exceeds that in bypass chamber 12 by a predetermined magnitude. Upon the opening of flap 24 exhaust gas may enter bypass chamber 12 through port 14 and leave through port 16, thereby avoiding coils 18 and 20.

Exhaust gas enters main chamber 10 by means of coaxial inlet 32 and leaves by means of coaxial outlet 34. In one embodiment inlet 32 and outlet 34 are 8 inches in diameter, although this dimension can be varied depending upon the ducts to which the device of FIG. 1 is coupled.

Fluid such as water may be circulated through coils 18 and 20 by pipes 36 and 38. In embodiments where coils 18 and 20 are used as a preheater for a hot water heater, pipe 36 may operate as a means for delivering potable water to the coils. Preheated water can be drawn from pipe 38 which then operates as a means for transferring water from the coils to the hot water heater. It is to be appreciated, however, that the direction of flow may be reversed. Although it is preferable to deliver water first to outer coil 20 since this coil is normally cooler than central, inner coil 18. Pipes 36 and 38 may be connected in various fashions to different equipment. For example, coils 18 and 20 may supply subsurface melting pipes. In the latter instance pipes 36 and 38 operate as a means for connecting melting pipes and, if desired, a pump.

A pump means is shown herein as water pump 40 which is mounted on bracket 42. Pump 40 has an inlet 44 and an outlet 46, the latter connecting to pipe 36. For most practical embodiments a pump will be employed to increase the flow rate and efficiency of the apparatus of FIG. 1, although it is possible for convection currents to sustain circulation.

Referring to FIG. 2, a downward sectional view along lines 2—2 of FIG. 1 is given. However, in this view flap 24 is shown closed, unlike FIG. 1. When closed, exhaust primarily flows through main chamber 10.

Referring to FIG. 3, a section of pipe from either coil 18 or 20 (FIG. 1) is illustrated in detail. As shown herein the pipe consists of a central conduit 50 having on it a plurality of annular fins 52. This finned arrangement encourages rapid conduction of exhaust heat through fins 52 to conduit 50. In one embodiment the conduit 50 had an inside diameter of $\frac{1}{2}$ inch and an outside diameter of $\frac{7}{8}$ inch. However, in other applications the dimensions of the pipe and fins may be altered depending upon the volume of exhaust, the amount of heat to be extracted etc.

Referring to FIG. 4, a schematic illustration is given of a system employing coils 18 and 20 of FIG. 1. Coils 18 and 20 are shown serially connected to pump 40. Also coil 18 is shown connected to pressure safety 54. Safety 54 operates to discharge water from the system if its pressure becomes excessive. Safety 54 empties into a floor drain 56. Water supplied by the water mains is schematically indicated by line 58 which connects to the inlet of pump 40 and main inlet 60 of hot water heater 62. The serial combination of pump 40, coils 18 and 20 and safety 54 are connected between main inlet 60 and inlet 64 of hot water heater 62. Auxiliary inlet 64 can be a special inlet or the drain normally found near the bottom of a conventional hot water heater. The outlet from hot water heater 62 is schematically illustrated as line 66.

Referring to FIG. 5, an alternate system is shown wherein coils 18 and 20 (this Figure and FIG. 1) operate to heat subsurface melting pipes. In this embodiment melting pipes are illustrated as a serpentine configuration of pipes 70 and 72. As an example, pipes 70 may be located below the surface of a walk leading to a house while pipe 72 may be below the surface of a driveway leading to a garage. Connected in series are subsurface pipes 70 and 72, pump 40, safety 54 and coils 18 and 20 (identical elements in this and the other Figure have the same reference numerals). Also serially connected with coil 18 is tank 74 having a orifice 76. The system is connected to circulate water and antifreeze in a single circuit, tank 74 being used as a reservoir, orifice 76 as a filling port.

Referring to FIG. 6, a schematic illustration is given of an alternate system using the device of FIG. 1. Heat producing equipment is shown herein as home heating furnace 80 of the hot water type. Furnace 80 has an output flue 82 which couples to apparatus 84 which is the equipment previously illustrated in FIG. 1. Above apparatus 84 is a flue 86 which leads to chimney 88. Installed on flue 86 is a balancing vent 90. This balancing vent relieves any back pressure or leaked exhaust within the furnace room by allowing a draft through vent 90 and up chimney 88. Vent 90 is regulated by balancing flap 92 which is normally biased by a weight (not shown) into the closed position, unless the back pressure in the room becomes excessive. The water heated by furnace 80 is circulated by pump unit 94 which has an output port feeding lines 96 and 98. The return to furnace 80 is through input ports 100 and 102. Lines 96 and 102 are a feeder and return, respectively, for radiators which may be coupled at connection 104. Serially connected to input port 100 is the input circulation feed of heat exchanger 108. Exchanger 108 is a conventional device which isolates the non-potable water in line 100 from potable water in its output feeds.

The output feeds of exchanger 108 are serially connected to pump 109. Also serially coupled with the input feed of heat exchanger 108 is safety 54 which is identical to the safeties previously illustrated in connection with FIGS. 4 and 5.

Serially connected between output port 98 and safety 54 are the coils of apparatus 84 (coils 18 and 20 of FIG. 1). In this embodiment lines 98 and 106 are operated as a means of connecting the coils of the apparatus 84 in circuit with ports 98 and 100.

The output circulation feeds of heat exchanger 108 may act as a preheater for a potable hot water system. Under such circumstances, input line 110 operates as a means for delivering potable water while line 112 operates as a means for transferring water to a hot water heater. The connection to a hot water system is effected by connecting lines 110 and 112 to lines 60 and 64, respectively, of FIG. 4.

To facilitate an understanding of the principles associated with the present invention, the operation of the apparatus of FIGS. 1 to 4 will be first described briefly. When the associated heat producing equipment is operating it draws hot exhaust past heating coils 18 and 20 (FIGS. 1 and 4) thereby heating them and the water passing through them. In one embodiment pump 40 is electrically connected in parallel with the electric motor associated with an oil burner. Accordingly, water circulates through coils 18 and 20 only when the furnace is operating. When operating, potable water is pumped from water mains 58 through coils 20 and 18, past safety 54 and into auxiliary input 64 of hot water heater 62. In a conventional hot water heater the water is brought initially to the bottom of the tank and is heated as it rises. Because of the upward circulation, injection of preheated water at lower input 64 does not interfere with the normal operation of a conventional hot water heater.

The equipment of FIG. 5 operates similar to that of FIG. 4 except that heated water is circulated through pipes 70 and 72 and tank 74. This latter system is a closed and continually circulates the same water, which need not be potable, through coils 18 and 20 and pipes 70 and 72, thereby melting surface ice or snow near the pipes. Since the system may employ non-potable water, antifreeze can be added to the system by means of orifice 76 in tank 74. Tank 74, being higher than the other system elements of FIG. 5, also acts as a reservoir to maintain the water level throughout the system.

The system of FIG. 6 operates similarly to the systems previously described, except heat is being supplied to exchanger 108 and furnace 80. Pump 94, normally supplied with furnace 80, is used to circulate hot water not only to radiators associated with furnace 80 but also to the coils of apparatus 84. Essentially, the coils of apparatus 84 are connected in parallel with the radiators that are across connection 104. Consequently, the heating coils of apparatus 84 act to boost the furnace 80. Heat normally lost through flue 86 preheats water returning to furnace 80 through input port 100. Also, the hot water circulated through the coils of apparatus 84 pass through heat exchanger 108 to supply auxiliary heat. For example, a portion of this recaptured heat may be used to preheat the water of a hot water system or a subsurface melting system.

It is to be appreciated that modifications and alterations may be implemented with respect to the apparatus described. For example, various materials may be used such as copper, aluminum, steel, plastic etc. Furthermore, the specific shapes and dimensions may be altered depending upon the particular environment, furnace capacity, the desired percentage of heat recapture, weight limitations, space limitations, etc. Furthermore, the coils disclosed herein may spiral or oscillate in various fashions. In addition, the waste heat recovered by the apparatus of this invention may be used to supply heat to many other devices besides those already described.

Obviously many other modifications and variations of the present invention are possible in light of the above teachings. It is therefore to be understood that within the scope of the appended claims, the invention may be practiced otherwise than as specifically described.

What is claimed is:

1. An energy recovery device for installation in the exhaust of heat producing equipment comprising:

a conduit having a main chamber and a bypass chamber enclosing a portion of said main chamber, said main chamber having a heat conducting inlet and outlet, and a common wall separating said chambers;

fluid conducting means mounted within said main chamber and having an inlet and an outlet for passing fluid therethrough; and relief means for connecting said main and bypass chambers in parallel flow relationship to the exhaust heat flowing through said chambers, said relief means acting in response to a differential pressure between said chambers exceeding a predetermined magnitude, said relief means including lower and upper openings in said common wall and a flap mounted on said lower opening and biased to a normally closed position.

2. An energy recovery device according to claim 1 wherein said fluid conducting means comprises a nested pair of hollow coils.

3. An energy recovery device according to claim 2 wherein said pair of coils are serially connected.

4. An energy recovery device according to claim 3 wherein said pair of coils are helical and concentric.

5. An energy recovery device according to claim 4 wherein said pair of coils have adjacent upper and lower ends, said upper ends being connected together.

6. An energy recovery device according to claim 3 wherein said coils comprise an outer and inner coil, said device further comprising:

pump means serially connected to said pair of coils for pumping fluid through said outer and then into said inner coil.

7. An energy recovery device according to claim 1 wherein said relief means includes:

a weight threadably attached to said flap, said weight being adjustably spaced from said flap to vary its closing force.

8. An energy recovery device according to claim 1 wherein said coils are finned.

9. An energy recovery device according to claim 5 wherein said main chamber is cylindrical and said inlet and outlet are coaxial.

10. An energy recovery device according to claim 3 arranged to preheat potable water for a hot water heater wherein said coils include:

means for delivering said potable water to said coils; and means for transferring said water from said coils to said hot water heater.

11. An energy recovery device according to claim 3 arranged to heat subsurface melting pipes wherein said coils include:

pump means serially connected to said coils; and means for connecting said melting pipes to said coils and pump means to form a circuit.

12. An energy recovery device according to claim 11 further comprising:

a tank serially connected to said coils, said tank being positioned at a higher elevation than said coils and melting pipes.

13. An energy recovery device according to claim 12 wherein said tank has an orifice for adding antifreeze.

14. An energy recovery device according to claim 3 arranged to preheat potable water for a hot water heater further comprising:

a heat exchanger having an input and output circulation feeds, said coils being serially connected to said input feeds;

means for delivering said potable water to said output circulation feeds; and means for transferring said water from said output feeds to said hot water heater.

15. An energy recovery device according to claim 14 wherein said heat producing equipment has an input and output port for externally circulating internally heated non-potable water, said energy recovery device comprising:

means for connecting said coils in circuit with said input and output port.

16. An energy recovery device according to claim 2 comprising:

a pressure safety coupled to said coils for releasing fluid therein upon its pressure exceeding a predetermined limit.

17. An energy recovery device according to claim 1 wherein said flap is hinged to the edge of said first opening.

* * * * *